US009416796B2

(12) United States Patent
VanWalleghem et al.

(10) Patent No.: US 9,416,796 B2
(45) Date of Patent: Aug. 16, 2016

(54) ENERGY ACCUMULATION APPARATUS

(71) Applicants: Curtis VanWalleghem, Toronto (CA); Cameron Lewis, Toronto (CA)

(72) Inventors: Curtis VanWalleghem, Toronto (CA); Cameron Lewis, Toronto (CA)

(73) Assignee: Hydrostor Inc. (CA)

( * ) Notice: Subject to any disclaimer, the term of this patent is extended or adjusted under 35 U.S.C. 154(b) by 34 days.

(21) Appl. No.: 14/167,242

(22) Filed: Jan. 29, 2014

(65) Prior Publication Data

US 2015/0211551 A1 Jul. 30, 2015

(51) Int. Cl.
*F15B 1/027* (2006.01)
*F15B 1/26* (2006.01)

(52) U.S. Cl.
CPC ..... *F15B 1/027* (2013.01); *F15B 1/265* (2013.01)

(58) Field of Classification Search
CPC ..... Y02E 10/38; Y02E 10/32
USPC ..... 290/42, 43, 53, 54; 60/495–501, 698; 417/330–333; 416/85; 415/5, 495
See application file for complete search history.

(56) References Cited

U.S. PATENT DOCUMENTS

| | | | | |
|---|---|---|---|---|
| 4,422,799 | A | 12/1983 | Green et al. | |
| 5,513,886 | A | 5/1996 | Cyr | |
| 6,450,732 | B1 * | 9/2002 | Boccotti | 405/76 |
| 2008/0093852 | A1 * | 4/2008 | Vowles et al. | 290/42 |
| 2009/0121486 | A1 * | 5/2009 | Ganley | 290/53 |
| 2009/0127860 | A1 * | 5/2009 | Brown | 290/53 |
| 2010/0107627 | A1 | 5/2010 | Morgan | |
| 2011/0031450 | A1 * | 2/2011 | Park et al. | 252/513 |
| 2012/0112472 | A1 | 5/2012 | Murray et al. | |
| 2012/0304637 | A1 * | 12/2012 | Allen et al. | 60/501 |
| 2013/0074758 | A1 * | 3/2013 | Powers et al. | 114/294 |
| 2014/0033624 | A1 | 2/2014 | Blaxland et al. | |

FOREIGN PATENT DOCUMENTS

| | | |
|---|---|---|
| FR | 2993016 | 1/2014 |
| WO | 2014170723 | 10/2014 |

OTHER PUBLICATIONS

PCT/IB2015/050582 International Search Report and Written Opinion, completed May 27, 2015.

* cited by examiner

*Primary Examiner* — Tulsidas C. Patel
*Assistant Examiner* — Sean Gugger
(74) *Attorney, Agent, or Firm* — Tarolli, Sundheim, Covell & Tummino LLP

(57) ABSTRACT

Disclosed is an energy-accumulation apparatus including an accumulator body assembly defining a pneumatically-pressurizable chamber. The pneumatically-pressurizable chamber is configured to communicate with a pneumatic-pressure source. The pneumatic-pressure source is positioned on a shore and being located away from a body of water. The energy-accumulation apparatus also includes an outer surface extending from the accumulator body assembly. The outer surface is configured to securely contact a sloped floor zone of a body of water at a position being spaced apart from a shore.

6 Claims, 11 Drawing Sheets

ENERGY ACCUMULATION APPARATUS

TECHNICAL FIELD

The technical field is generally related to an energy-accumulation apparatus.

BACKGROUND

Energy storage is accomplished by devices and/or physical media configured to receive and to store energy, and to provide the stored energy that is to be consumed or used at a later time (on demand) for useful operations as may be required. A device configured to store energy is called an energy-accumulation apparatus.

A renewable-energy system (such as a wind turbine and/or a solar panel) is configured to convert energy received from a renewable-energy source (wind and/or solar) into electricity, which may be classified as intermittent electric power. Wherever intermittent power sources are connected to (deployed in) an electrical grid (or grid), energy storage becomes an option to improve reliable supply of energy.

The excess electricity generated by the renewable-energy system can be used to manufacture pressurized air, which is then stored in an underwater compressed air system. Underwater compressed air systems generally store excess energy as compressed air underwater. This stored compressed air is then converted back into electricity when needed, upon demand, by using conversion systems for such a process (for example, when there is an energy production deficiency); then, the converted electricity is placed on an electric grid for subsequent distribution to electric users. Using these energy storage and retrieval systems can help electric utilities provide a supply of electricity when the demand is relatively higher without the need to constantly produce excess energy.

SUMMARY

Problems associated with known energy-accumulation apparatus were researched. After much study, an understanding of the problem and its solution has been identified, which is stated below.

Energy storage solutions utilizing an underwater compressed air process include air storage apparatus for storing compressed air underwater. Generally, these storage solutions deploy these air storage apparatuses in an area that is geographically flat. In some circumstances, however, air storage apparatuses may need to be deployed on sloped surfaces. For example, in some locations the flat zone may be insufficiently large to accommodate the number of air storage apparatuses required for the energy storage solution. In other locations, a flat zone may not be available.

In order to mitigate, at least in part, the problem(s) identified above, in accordance with an aspect, there is provided an energy-accumulation apparatus including an accumulator body assembly defining a pneumatically-pressurizable chamber. The pneumatically-pressurizable chamber is configured to communicate with a pneumatic-pressure source. The pneumatic-pressure source is positioned on a shore and is located away from a body of water.

The energy-accumulation apparatus also includes an outer surface extending from the accumulator body assembly. The outer surface is configured to securely contact a sloped floor zone of a body of water at a position being spaced apart from a shore.

In order to mitigate, at least in part, the problem(s) identified above, in accordance with an aspect, there is provided a renewable-energy electric-generating system, including: the energy-accumulation apparatus.

In order to mitigate, at least in part, the problem(s) identified above, in accordance with an aspect, there is provided an electric grid, including the energy-accumulation apparatus.

In order to mitigate, at least in part, the problem(s) identified above, in accordance with an aspect, there is provided a method, comprising securely contacting an outer surface extending from an accumulator body assembly of an energy-accumulation apparatus to a sloped floor zone of a body of water, the accumulator body assembly defining a pneumatically-pressurizable chamber.

In order to mitigate, at least in part, the problem(s) identified above, in accordance with an aspect, there is provided other aspects as identified in the claims.

Other aspects and features of the non-limiting embodiments may now become apparent to those skilled in the art upon review of the following detailed description of the non-limiting embodiments with the accompanying drawings.

Deploying an energy storage apparatus on non-level or non-flat terrain can be problematic. For example, when deployed on a slope, there is the risk that the deployed apparatuses may slide down the sloped floor zone over time. In other examples, gravitational, current, and wave effects may cause the deployed apparatus to move from its originally deployed location.

BRIEF DESCRIPTION OF DRAWINGS

The non-limiting embodiments may be more fully appreciated by reference to the following detailed description of the non-limiting embodiments when taken in conjunction with the accompanying drawings, in which.

Figure 1A:
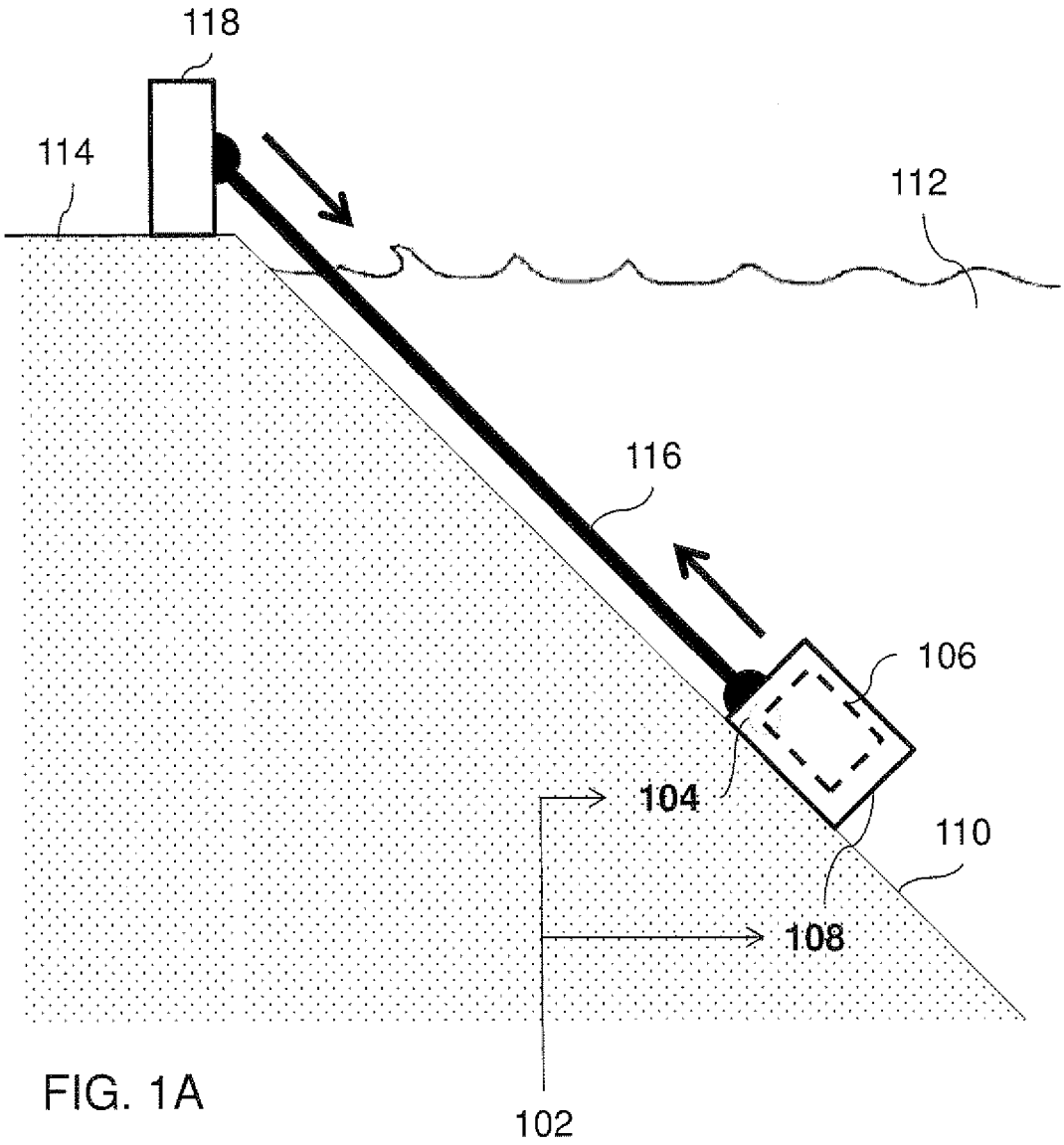
FIG. 1A (SHEET (1/11) depicts a schematic diagram of an example of an accumulator assembly.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. In addition, common, but well-understood, elements that are useful or necessary in commercially feasible embodiments are often not depicted in order to facilitate a less obstructed view of the various embodiments of the present disclosure.

LISTING OF REFERENCE NUMERALS USED IN THE DRAWINGS

102 energy-accumulation apparatus
104 accumulator body assembly
106 pneumatically-pressurizable chamber
108 outer surface
110 sloped floor zone
112 body of water
114 shore
116 shore connection
118 on-shore anchor
201 air-feed channel
202 pneumatic-pressure source
210 air-feeder line
212 air-feeder passageway
214 couplers
300 off-shore anchor assembly
302 anchor extension
304 anchor body
306 anchor line
308 mat structure
310 weight
900 renewable-energy electric-generating system
902 electric grid
908 electric generator

DETAILED DESCRIPTION OF THE EXEMPLARY EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of the description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples), aspects and/or concepts defined in the appended claims. Hence, specific dimensions and other physical characteristics relating to the embodiments disclosed herein are not to be considered as limiting, unless the claims expressly state otherwise. It is understood that "at least one" is equivalent to "a".

With general reference to all of the figures, there is depicted an energy-accumulation apparatus (102). The energy-accumulation apparatus (102) includes an accumulator body assembly (104). The accumulator body assembly (104) defines a pneumatically-pressurizable chamber (106). The pneumatically-pressurizable chamber (106) is configured to communicate with a pneumatic-pressure source (202). The pneumatic-pressure source (202) is positioned on a shore (114) and is located away from a body of water (112). The energy-accumulation apparatus (102) further includes an outer surface (108) extending from the accumulator body assembly (104). The outer surface (108) is configured to securely contact a sloped floor zone (110) of a body of water (112) at a position being spaced apart from a shore (114). It will be appreciated that the body of water (112) may include an ocean, a lake, a river, a pond, etc. The figures depict various options and configurations and/or arrangements of the energy-accumulation apparatus (102).

FIG. 1A (SHEET 1/11) depicts the schematic representations (cross-sectional views) of the energy-accumulation apparatus (102) in which the energy-accumulation apparatus (102) includes a combination of an on-shore anchor (118) and a shore connection (116). The shore connection (116) may be called a tension line. The on-shore anchor (118) is positioned on a shore (114) and is spaced apart from the body of water (112). The energy-accumulation apparatus (102) is positioned on a sloped floor zone (110) of a body of water (112) and is configured to be connected to the on-shore anchor (118) via the shore connection (116).

Figure 1B:
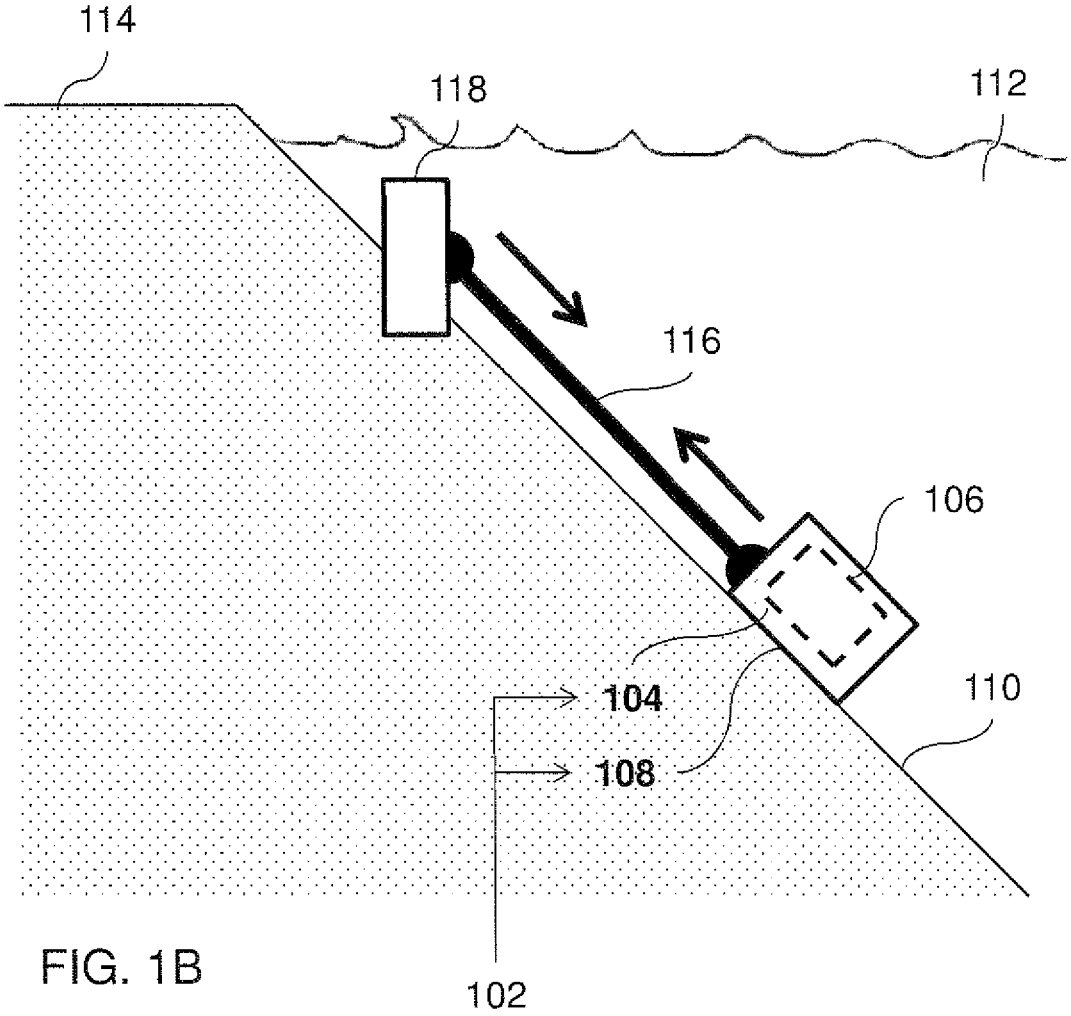
FIG. 1B (SHEET (2/11) depicts another schematic diagram of an example of the accumulator assembly of FIG. 1A.

FIG. 1B (SHEET 2/11) depicts the schematic representation (cross-sectional view) of the energy-accumulation apparatus (102) in which the energy-accumulation apparatus (102) includes a combination of the on-shore anchor (118) and the shore connection (116). The on-shore anchor (118) is positioned in the body of water (112) on a sloped floor zone (110) of the body of water (112), and spaced apart from the shore (114). The energy-accumulation apparatus (102) is configured to be connected to the on-shore anchor (118) via the shore connection (116).

As depicted in FIG. 1B, it may not be necessary for the on-shore anchor (118) to be on the shore (114) and away from the ocean. It may be preferable to install the on-shore anchor (118) in shallow waters near the shore (114). In some of these deployments, the on-shore anchor (118) may be partially or fully submerged in the body of water (112). It may be preferable to deploy the on-shore anchor (118) up-slope of the energy-accumulation apparatus (102).

Figure 2A:
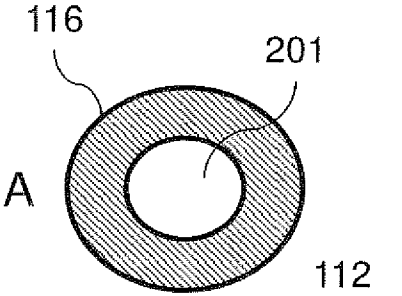
FIG. 2A (SHEET (3/11) depicts yet another schematic diagram of an example of the accumulator assembly of FIG. 1A.
Figure 2B:
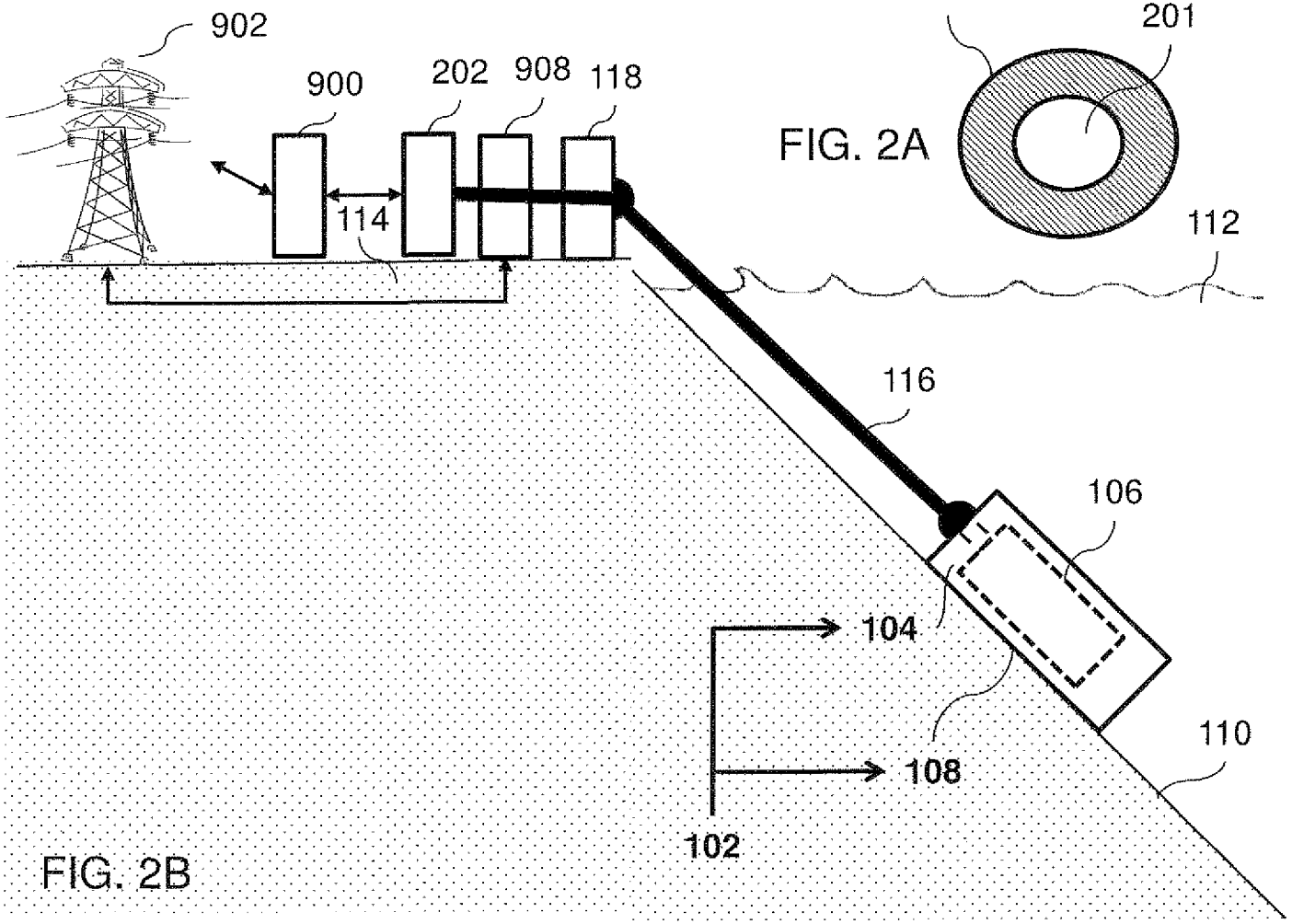
FIG. 2B (SHEET (3/11) depicts yet another schematic diagram of an example of the accumulator assembly of FIG. 1A.

FIG. 2A and FIG. 2B (SHEET 3/11) depict the schematic representations (cross-sectional views) of the energy-accumulation apparatus (102) in which the energy-accumulation apparatus (102) of FIG. 1A is adapted. The on-shore anchor (118) is positioned away from the body of water (112). The shore connection (116) defines (provides) an air-feed channel (201) configured to be in pneumatic communication with the energy-accumulation apparatus (102). It will be appreciated that the configuration depicted in FIG. 2B may be applied to the configuration of FIG. 1A (if so desired).

Referring to FIG. 2B (SHEET 3/11), there is further depicted a renewable-energy electric-generating system (900) positioned on the shore (114). The renewable-energy electric-generating system (900) is configured to generate electricity in response to interaction with a renewable-energy source. The renewable-energy electric-generating system (900) includes, for example, any one of a wind-turbine assembly and a solar-panel assembly. The renewable-energy electric-generating system (900) is located or positioned near (proximate to) a body of water (112). The renewable-energy electric-generating system (900) is configured to connect to an electric grid (902).

The renewable-energy electric-generating system (900) is also configured to connect to a pneumatic-pressure source (202), and to supply electricity to the pneumatic-pressure source (202) during times when there is a relatively lower demand for electricity from the electric grid (902). The renewable-energy electric-generating system (900) may provide electricity to the electric grid (902) during a relatively lower demand from the electric grid (902) while providing electricity to the pneumatic-pressure source (202). The pneumatic-pressure source (202) is configured to generate pneumatic pressure (air pressure). The energy-accumulation apparatus (102), which is positioned in the body of water (112), is configured to be in communication with the pneumatic-pressure source (202). The pneumatic-pressure source (202) is configured to fill the instances of the energy-accumulation apparatus (102) with pneumatically-pressurized air.

The energy-accumulation apparatus (102) is operatively connected to an electric generator (908). The electric generator (908) is configured to generate electricity using pneumatic pressure as the input source (from the energy-accumulation apparatus (102)); the pneumatically pressurized air is released from the energy-accumulation apparatus (102) in such a way that the electric generator (908) may generate electricity to be immediately provided to the electric grid (902), perhaps when there is a relatively higher electricity demand.

Figure 2C:
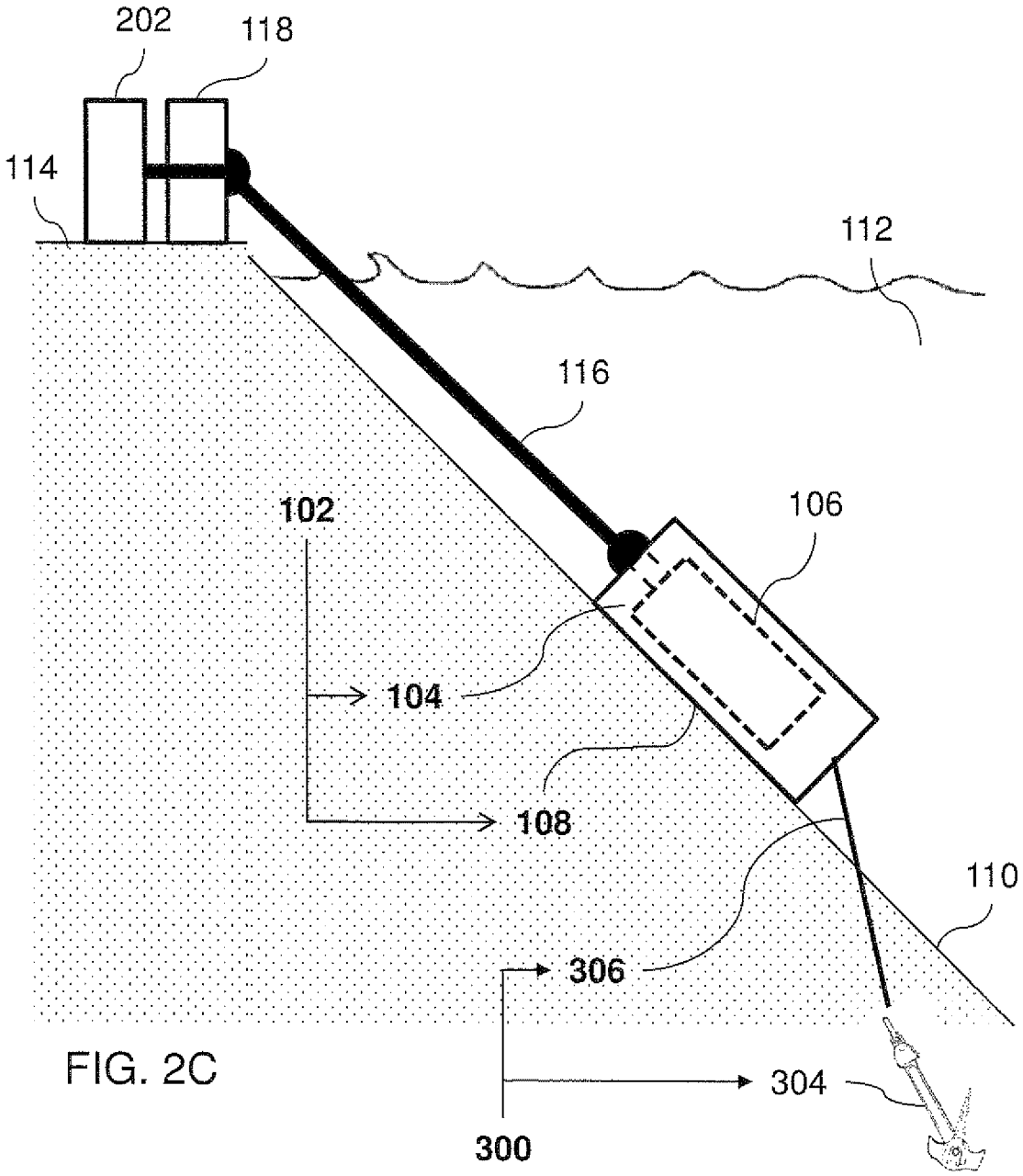
FIG. 2C (SHEET 4/11) depicts yet another schematic diagram of an example of the accumulator assembly of FIG. 1A.

FIG. 2C (SHEET 4/11) depicts the schematic representation (cross-sectional view) of the energy-accumulation apparatus (102) in which the energy-accumulation apparatus (102) of FIG. 2B is adapted. The energy-accumulation apparatus (102) includes a combination of the on-shore anchor (118) and an off-shore anchor assembly (300) having an anchor body (304). It will be appreciated that the configuration depicted in FIG. 2C may be applied to the configuration of FIG. 2B (if so desired). The off-shore anchor assembly (300) is configured to anchor a portion of the energy-accumulation apparatus (102) that is positioned further down the sloped floor zone (110). The on-shore anchor (118) is configured to anchor another portion of the energy-accumulation apparatus (102) that is positioned further up the sloped floor zone (110). The shore connection (116) defines an air-feed channel (201) (as depicted in FIG. 2A). The air-feed channel (201) is configured to be in pneumatic communication with the energy-accumulation apparatus (102).

Figure 2D:
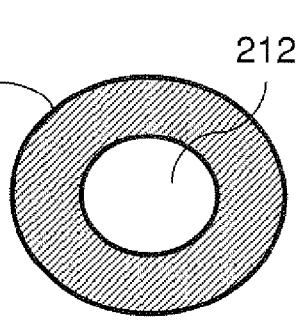
FIG. 2D (SHEET (5/11) depicts yet another schematic diagram of an example of the accumulator assembly of FIG. 1A.
Figure 2E:
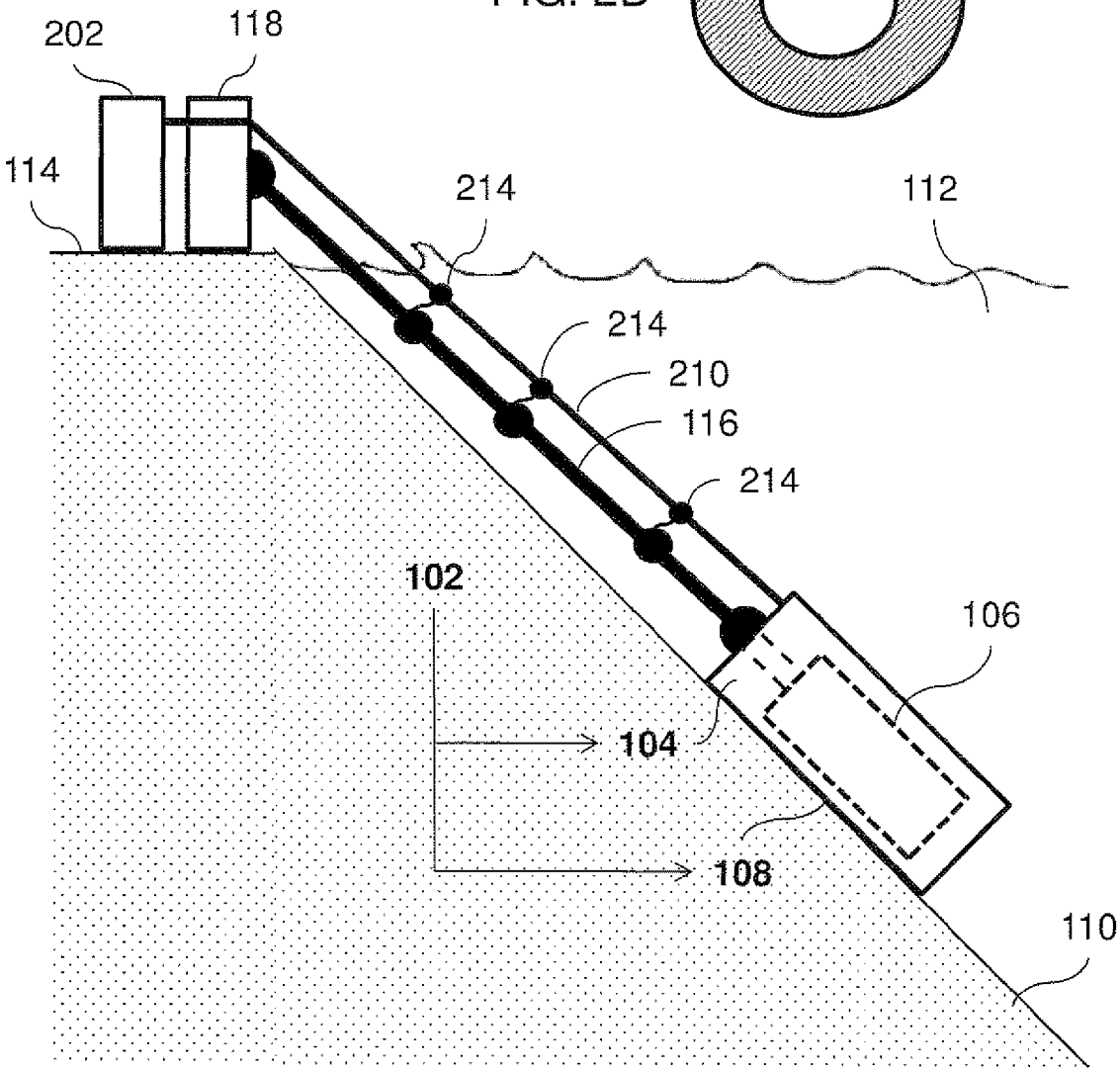
FIG. 2E (SHEET 5/11) depicts yet another schematic diagram of an example of the accumulator assembly of FIG. 1A.

FIG. 2D and FIG. 2E (SHEET 5/11) depict the schematic representations (cross-sectional views) of the energy-accumulation apparatus (102) in which the energy-accumulation apparatus (102) is adapted. The energy-accumulation apparatus (102) includes a combination of an air-feeder line (210) and the shore connection (116). The air-feeder line (210) defines (provides) an air-feeder passageway (212). The air-feeder line (210) is spaced apart from the shore connection (116) and is coupled to from the shore connection (116) (as depicted in FIG. 2E). As an option, the air-feed channel (201) (as depicted in FIG. 2A) is configured to be in pneumatic communication with the energy-accumulation apparatus (102). In accordance with an option (as depicted), the air-feeder line (210) is spaced apart and is not coupled to the shore connection (116) (this option is not depicted), and of course weight may be applied to the air-feeder line (210) of this option to help keep the air-feeder line (210) submerged in water.

Figure 2F:
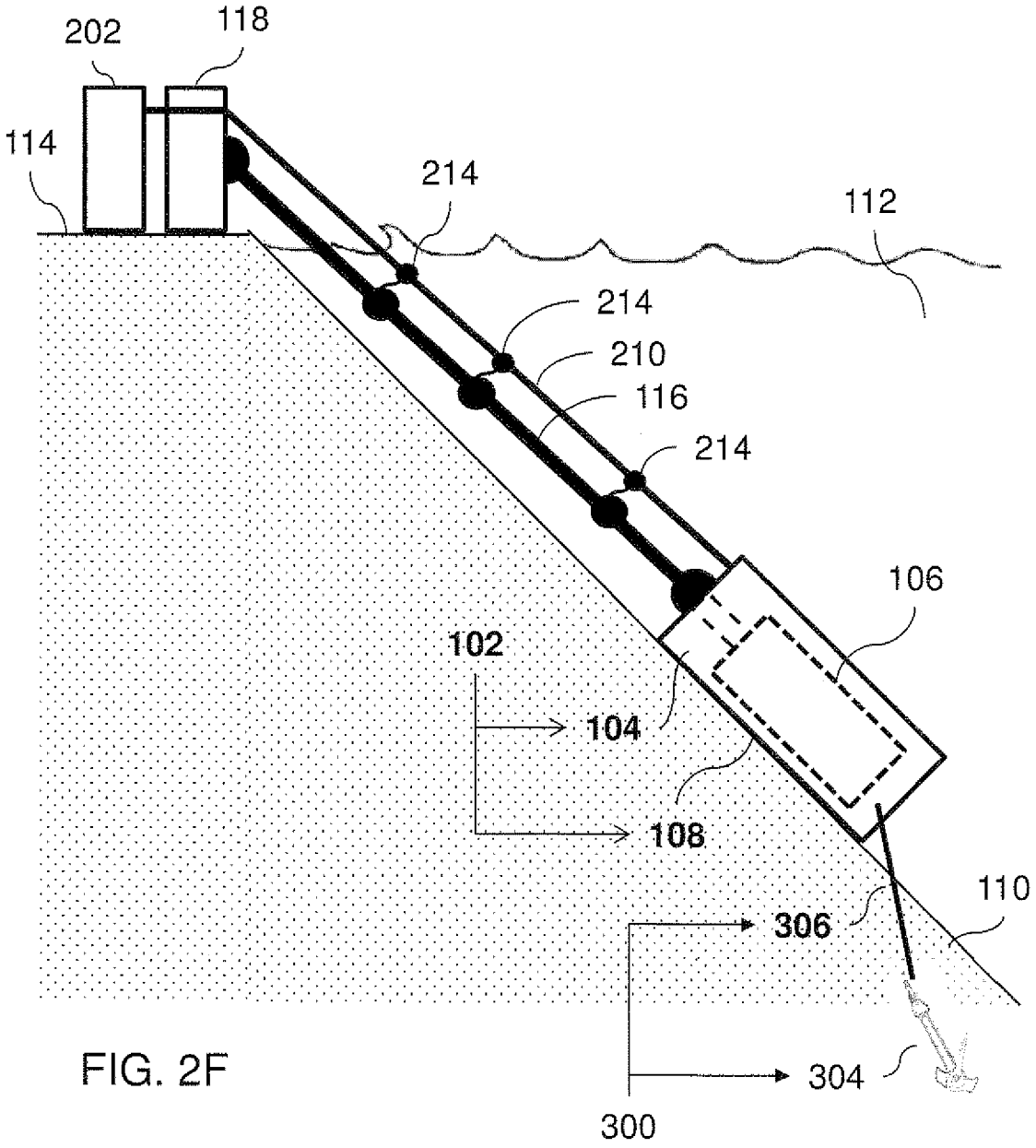
FIG. 2F (SHEET 6/11) depicts yet another schematic diagram of an example of the accumulator assembly of FIG. 1A.

FIG. 2F (SHEET 6/11) depicts the schematic representation (cross-sectional view) of the energy-accumulation apparatus (102) in which the energy-accumulation apparatus (102) of FIG. 2E is adapted. In accordance with this option, the off-shore anchor assembly (300) is configured to anchor a portion of the energy-accumulation apparatus (102) that is positioned further down the sloped floor zone (110). The on-shore anchor (118) is configured to anchor another portion of the energy-accumulation apparatus (102) that is positioned further up the sloped floor zone (110).

Figures 2G, 2H, 2I:
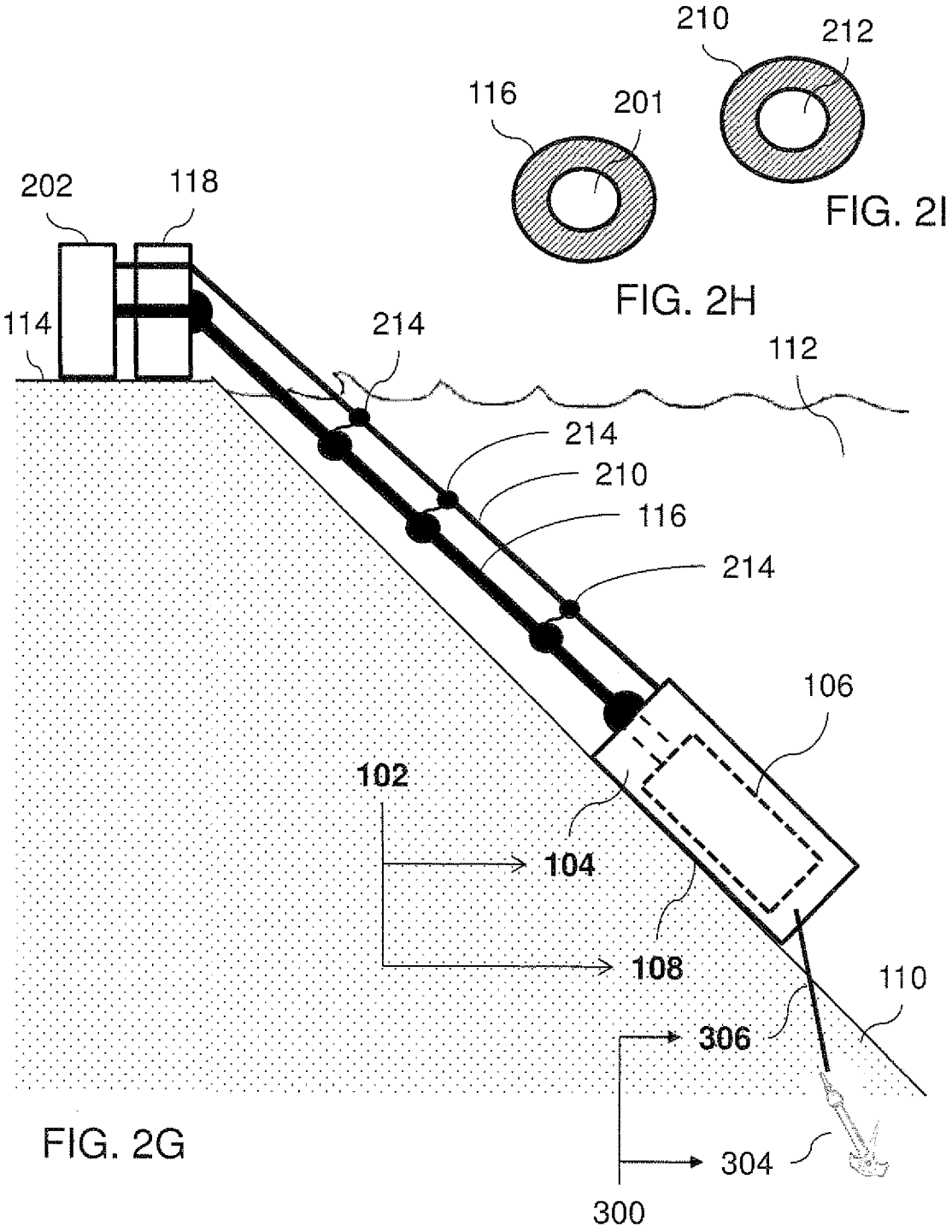
FIG. 2G (SHEET 7/11) depicts yet another schematic diagram of an example of the accumulator assembly of FIG. 1A.
FIG. 2H (SHEET 7/11) depicts yet another schematic diagram of an example of the accumulator assembly of FIG. 1A.
FIG. 2I (SHEET 7/11) depicts yet another schematic diagram of an example of the accumulator assembly of FIG. 1A.

FIG. 2G, FIG. 2H, and FIG. 2I (SHEET 7/11) depict the schematic representations (cross-sectional views) of the energy-accumulation apparatus (102) in which the energy-accumulation apparatus (102) of FIG. 2F is adapted. In accordance with this option, the shore connection (116) defines (provides) the air-feed channel (201) is configured to be in pneumatic communication with the energy-accumulation apparatus (102). As well, the air-feeder line (210) defines (provides) the air-feeder passageway (212). The air-feed channel (201) configured to be in pneumatic communication with the energy-accumulation apparatus (102). Both the air-feeder line (210) and the shore connection (116) are configured in such a way that pressurized air communicates with a pneumatic-pressure source (202) positioned on the shore (114) and away from the body of water (112). This configuration may be used, as a non-limiting example, to improve the rate of flow of pressurized air between the air handling system and the accumulator when compared to using either the air-feeder line (210) or on shore connection (116) alone.

Furthermore, as is shown in FIG. 2G, the off-shore anchor assembly (300) is configured to anchor a portion of the energy-accumulation apparatus (102) that is positioned further down the sloped floor zone (110). The on-shore anchor (118) is configured to anchor another portion of the energy-accumulation apparatus (102) that is positioned further up the sloped floor zone (110).

Figure 3A:
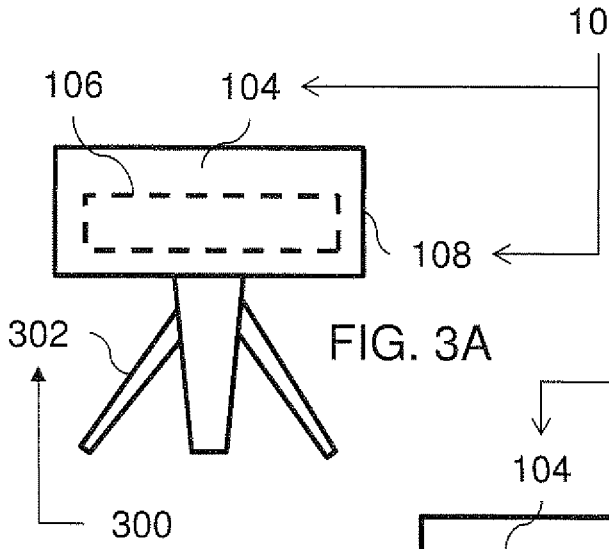
FIG. 3A (SHEET 8/11) depicts yet another schematic diagram of an example of the accumulator assembly of FIG. 1A.
Figure 3B:
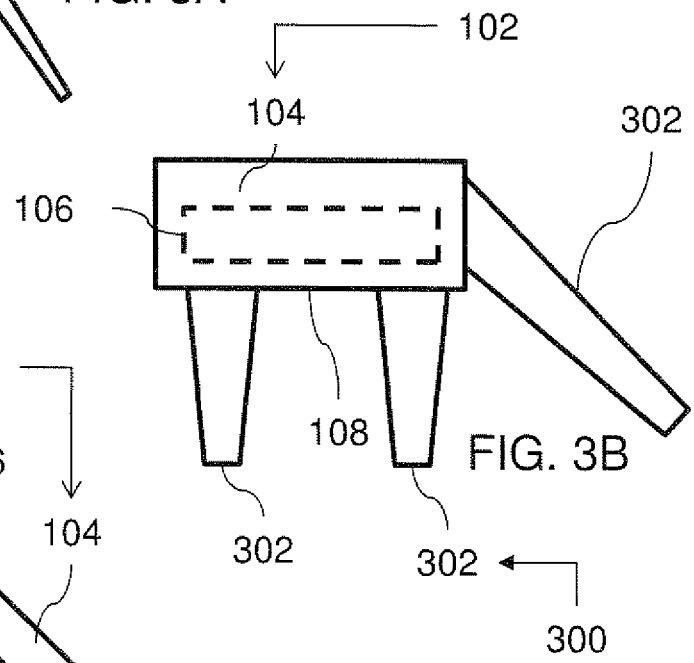
FIG. 3B (SHEET 8/11) depicts yet another schematic diagram of an example of the accumulator assembly of FIG. 1A.
Figure 3C:
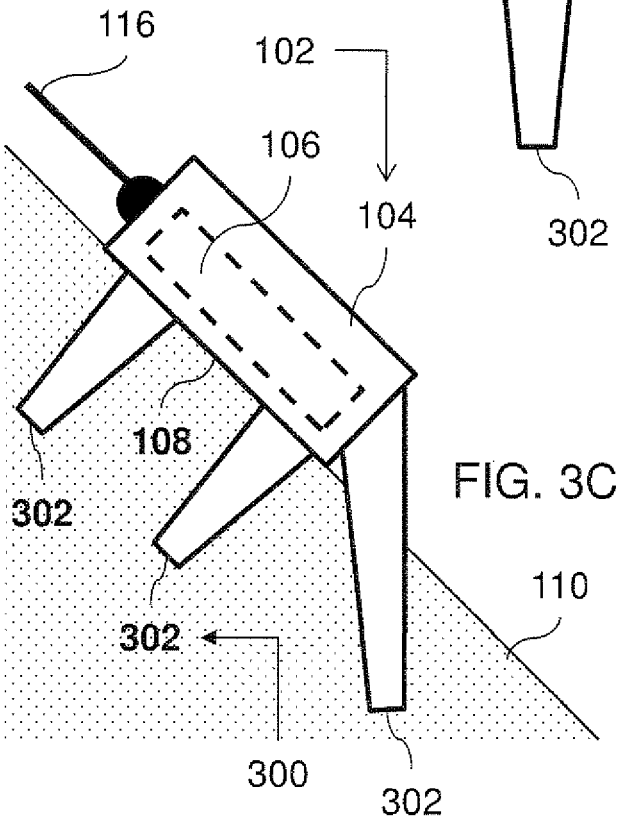
FIG. 3C (SHEET 8/11) depicts yet another schematic diagram of an example of the accumulator assembly of FIG. 1A.

FIG. 3A, FIG. 3B and FIG. 3C (SHEET 8/11) depict the schematic representation (cross-sectional view) of the energy-accumulation apparatus (102) in which the energy-accumulation apparatus (102) includes an off-shore anchor assembly (300). The off-shore anchor assembly (300) includes an anchor extension (302). The anchor extension (302) is configured to fixedly extend from the energy-accumulation apparatus (102) in such a way that once the energy-accumulation apparatus (102) is positioned on (proximate to) the sloped floor zone (110), the anchor extension (302) fixedly extends from the energy-accumulation apparatus (102)

and into the sloped floor zone (110). The anchor extension (302) is configured to fixedly anchor (position) the energy-accumulation apparatus (102) to the sloped floor zone (110).

As shown in FIG. 3A, the anchor extension (302) may be configured to extend into the sloped floor zone (110) such that the anchor extension (302) is buried, at least in part, in the sloped floor zone (110). As shown in FIG. 3B, different types of the anchor extension (302) may be used to fixedly anchor (position) the energy-accumulation apparatus (102) into the sloped floor zone (110). Some instances of the anchor extension (302) may be mostly buried in the sloped floor zone (110), and other instances of the anchor extension (302) may be partially buried in the sloped floor zone (110). FIG. 3C shows an energy-accumulation apparatus (102) having both mostly buried and partially buried instances of the anchor extension (302) deployed in a sloped floor zone (110).

Figures 3D, 3E:
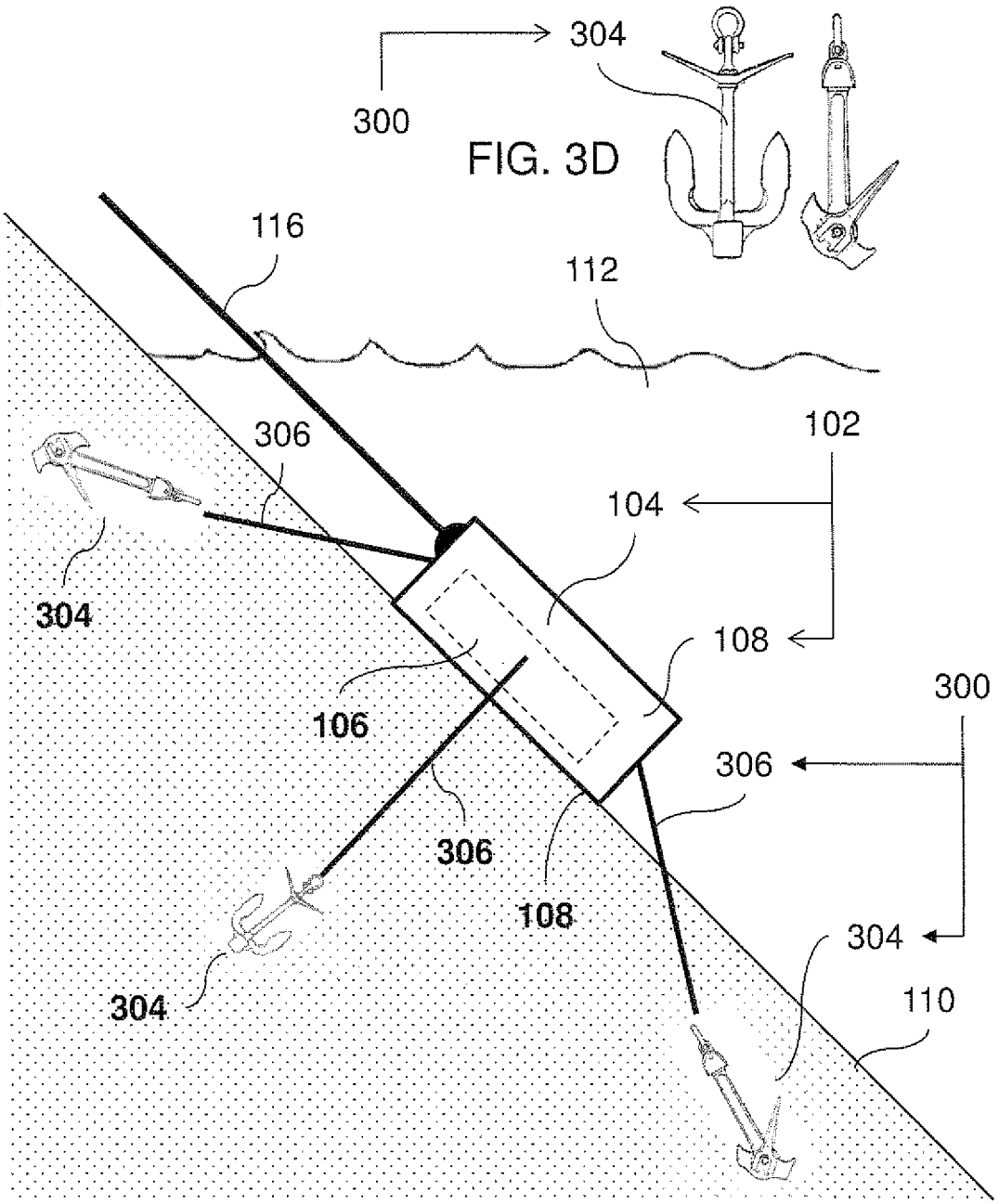
FIG. 3D (SHEET 9/11) depicts yet another schematic diagram of an example of the accumulator assembly of FIG. 1A.
FIG. 3E (SHEET 9/11) depicts yet another schematic diagram of an example of the accumulator assembly of FIG. 1A.

FIG. 3D and FIG. 3E (SHEET 9/11) depict the schematic representations (cross-sectional view) of the off-shore anchor assembly (300) having the anchor body (304) of the energy-accumulation apparatus (102), and examples of deployment of the anchor body (304). As depicted in FIG. 3E, the instances of the off-shore anchor assembly (300) are deployed up-slope, down-slope, and at the same level as the energy-accumulation apparatus (102). The off shore anchor assembly (300) includes the anchor body (304) and the anchor line (306). The anchor body (304) is configured to be positioned in the sloped floor zone (110) once the energy-accumulation apparatus (102) is positioned to do just so. The anchor line (306) is configured to operatively connect the anchor body (304) to the accumulator body assembly (104).

Figure 3F:
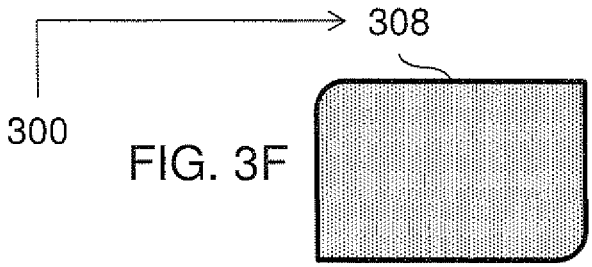
FIG. 3F (SHEET 10/11) depicts yet another schematic diagram of an example of the accumulator assembly of FIG. 1A.
Figure 3G:
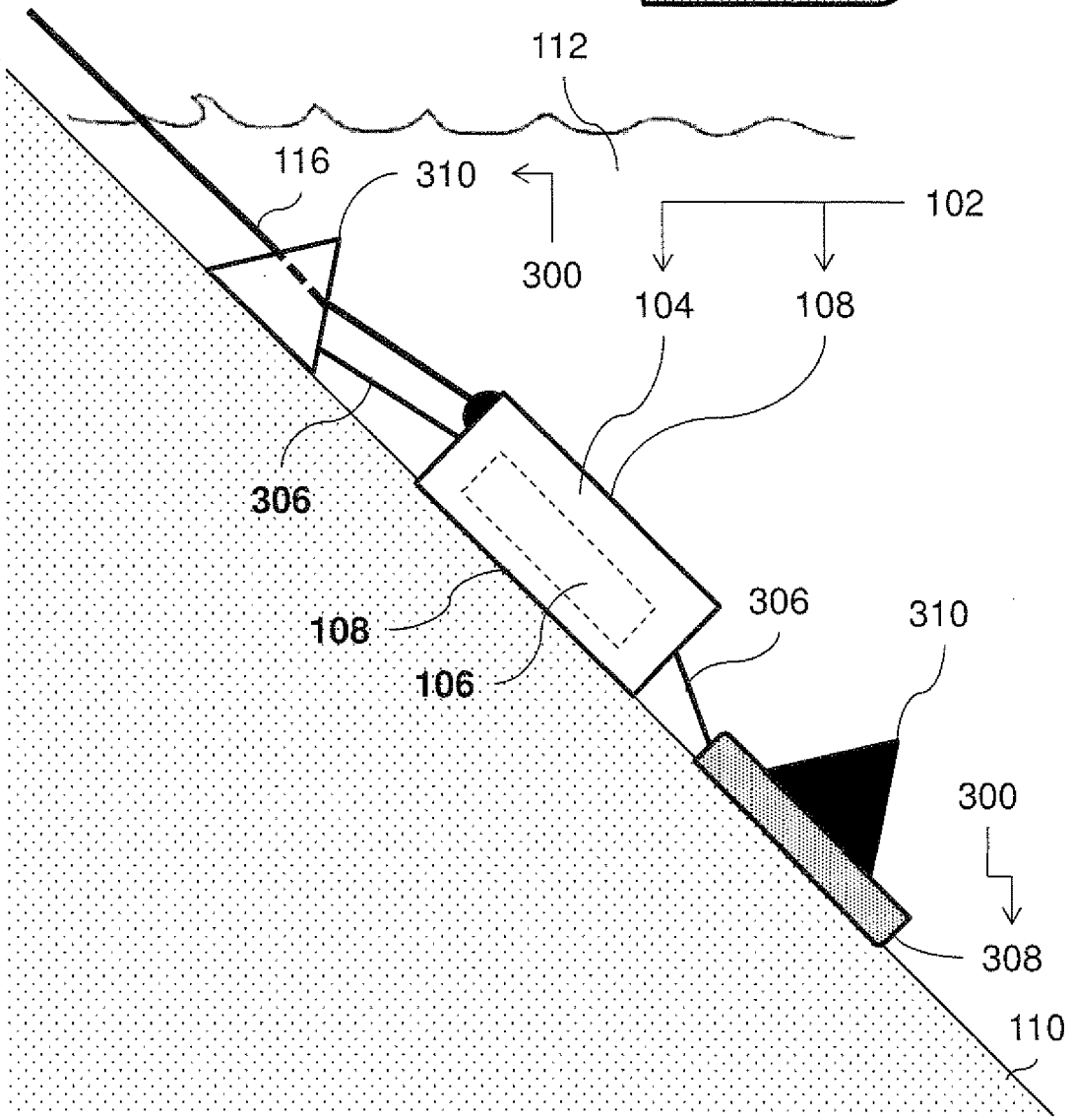
FIG. 3G (SHEET 10/11) depicts yet another schematic diagram of an example of the accumulator assembly of FIG. 1A.

FIG. 3F and FIG. 3G (SHEET 10/11) depict the schematic representations (cross-sectional view) of the off-shore anchor assembly (300), and various examples of deployment thereof. Referring to FIG. 3F and FIG. 3G, the anchor line (306) is connected the accumulator body assembly (104) to a mat structure (308). The mat structure (308) is configured to be positioned in the sloped floor zone (110) once the energy-accumulation apparatus (102) is positioned to do just so. The mat structure (308) is configured to be covered by a weight (310). When the mat structure (308) is covered by a weight (310) it would act very much like the anchor body (304) of FIG. 3D. Examples of weights include, but are not limited to, aggregate, landfill, rocks, boulders, or construction waste.

The mat structure (308) includes a resilient material for supporting the weight (310) in an ocean environment. Examples include, but are not limited to: a geo-tech mat; a sheet of a corrosion-resistant or corrosion-proof metal; a sheet made of man-made fabrics such as nylon, plastic, or polyurethane; a sheet of natural fabrics such as cotton, wool, hemp; a web or net of man-made fabrics; a net or web of natural fabrics; a net or web of corrosion-resistant or corrosion-proof metal; or any combination of the above.

Referring to FIG. 3G, the weight (310) is applied to the shore connection (116). This arrangement is useful in keeping the shore connection (116) secure relative to the sloped floor zone (110). For the case where the shore connection (116) defines the air-feed channel (201) as depicted in FIG. 2A), the weight (310) is configured to reduce the buoyancy of the shore connection (116) once positioned underwater. In another option (not depicted), the weight (310) may be applied to the air-feeder line (210) of FIG. 4A, and the weight (310) is configured to secure and reduce the buoyancy of the air-feeder line (210) for this option (similar to the option depicted in FIG. 3G).

Figures 4A, 4B:
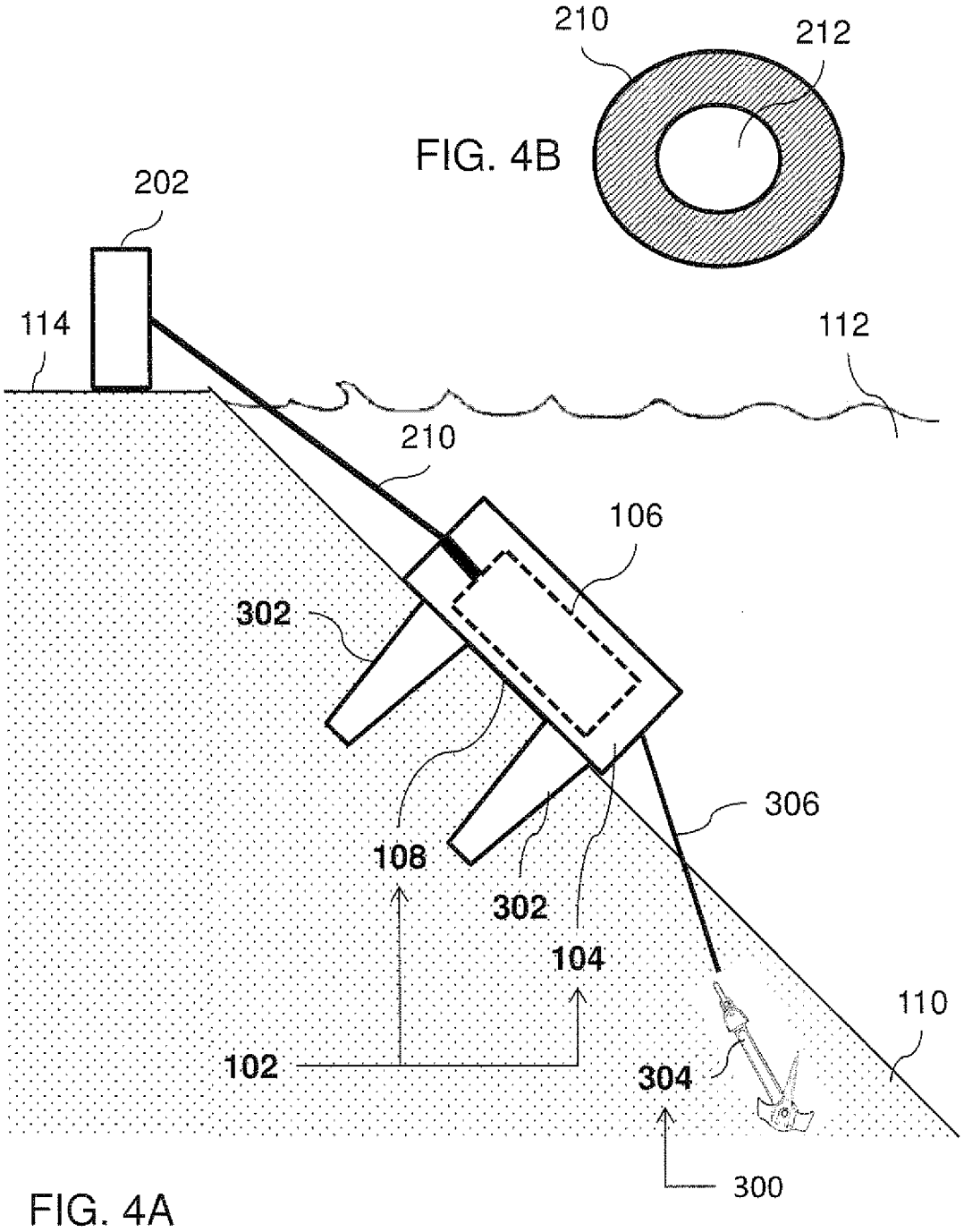
FIG. 4A (SHEET 11/11) depicts yet another schematic diagram of an example of the accumulator assembly of FIG. 1A.
FIG. 4B (SHEET 11/11) depicts yet another schematic diagram of an example of the accumulator assembly of FIG. 1A.

FIG. 4A and FIG. 4B (SHEET 11/11) depict the schematic representations (cross-sectional view) of the energy-accumulation apparatus (102). The energy-accumulation apparatus (102) does not include the shore connection (116) and the on-shore anchor (118) both of FIG. 1A. The energy-accumulation apparatus (102) includes the air-feeder line (210) and the off-shore anchor assembly (300) configured to anchor the energy-accumulation apparatus (102) to the sloped floor zone (110). The instances of the off-shore anchor assembly (300) are configured to secure the energy-accumulation apparatus (102) to the sloped floor zone (110). The shore connection (116) and the on-shore anchor (118) are not required (in the option depicted in FIG. 4A) to secure the energy-accumulation apparatus (102) to the sloped floor zone (110). This may be useful in scenarios where the on-shore anchor (118) may not be deployable for regulatory or geographical restrictions.

Referring to FIGS. 2B, 2C, 2E, and 4A, the pneumatically-pressurizable chamber (106) is configured to communicate with a pneumatic-pressure source (202). This pneumatic-pressure source (202) may be positioned on a shore (114) that is located away from the body of water (112). Examples of a pneumatic-pressure source (202) include a pressurized air system configured to convey or provide pressurized air to the pneumatically-pressurizable chamber (106). The pressurized air system is configured to convert excess energy generated by a power generator into pressurized air. The pneumatic-pressure source (202) is deployed on the shore (114) at a position located away from the body of water (112). The pneumatic-pressure source (202) includes a pressurized air system configured to convey or provide pressurized air to the pneumatically-pressurizable chamber (106).

Referring to FIGS. 2B, 2C, 2E, and 4A, the outer surface (108) and the accumulator body assembly (104) may be configured to be positioned in the body of water (112) and away from the shore (114) once the accumulator body assembly (104) is positioned to do just so. Furthermore, the outer surface (108) may be configured to securely contact a sloped floor zone (110) of the body of water (112) once the accumulator body assembly (104) is positioned to do just so in such a way that the accumulator body assembly (104) is securable in- a stationary position relative to the sloped floor zone (110).

Referring to FIGS. 2B, 2C, 2E, and 4A, the accumulator body assembly (104) may be rigid. In some examples, the accumulator body assembly (104) may be constructed of rigid materials such as concrete, plastic, or metal. This may be useful in some scenarios where the floor zone is rocky or contains features that could damage the accumulator body assembly (104). The accumulator body assembly (104) may be adjustable based on the amount of pneumatic pressure in the accumulator body assembly (104). In some scenarios, the accumulator body assembly (104) may inflate or deflate based on the amount of pneumatic pressure in the accumulator body assembly (104). The accumulator body assembly (104) may be made of a resilient but flexible material such as rubber, elasticized plastic, latex, or any flexible material suitable for deployment in water and capable of withstanding large amounts of pressure.

Referring to FIGS. 1A, 1B, 2B, 2C, 2E, 3C, 3E, 3G, and 4A, the outer surface (108) is configured to be positioned, at least in part, on the sloped floor zone (110) of the body of water (112) once the energy-accumulation apparatus (102) is positioned to do just so. The outer surface (108) may be made of the same material as the accumulator body assembly (104), as described above. The outer surface (108) may be made of some other material better suited for constant contact with the sloped floor zone (110) of the body of water (112). In some examples the outer surface (108) may be made of metal or plastic while the accumulator body assembly (104) may be made of concrete, plastic, or metal.

Referring to FIGS. 1A, 213, 2C, and 2E, the energy-accumulation apparatus (102) further includes a shore connection (116) configured to operatively connect the energy-accumulation apparatus (102) to an on-shore anchor (118) being positioned on the shore (114) and away from the body of water (112). The shore connection (116) may include tension lines, conduit, piping, or any other connection apparatus to connect the energy-accumulation apparatus (102) to the on-shore anchor (118). Non-limiting examples of an on-shore anchor (118) include, but are not limited to, rocks, boulders, buildings, man-made structures, docks, piers, break-walls, dams, levees, pylons, posts, or dykes. The shore connection (116) may be connected to the on-shore anchor (118) and the energy-accumulation apparatus (102) through well-known connection methods. For example, hooks and loops can be configured on the on-shore anchor (118), energy-accumulation apparatus (102), and the shore connection (116) so as to connect the on-shore anchor (118), the energy-accumulation apparatus (102), and the shore connection (116). A skilled technician would understand that any connection apparatus could be used without departing from the scope of this disclosure. For instance, bolts could be used to connect the shore connection (116) to the energy-accumulation apparatus (102) to the on-shore anchor (118).

Referring to FIGS. 3A, 3B, 3C, 3E and 3G, and 4A, the energy-accumulation apparatus (102) also includes an off-shore anchor assembly (300) extending from the energy-accumulation apparatus (102). This off-shore anchor assembly (300) is configured to securely anchor, at least in part, the energy-accumulation apparatus (102) to the sloped floor zone (110).

Referring to FIGS. 3A, 3B, 3C, and 4A, the off-shore anchor assembly (300) may be an anchor extension (302) of the outer surface (108) of the energy-accumulation apparatus (102). The instances of the anchor extension (302) may be configured to securely anchor, at least in part, the energy-accumulation apparatus (102) to the sloped floor zone (110). The anchor extension (302), as non-limiting examples, may be configured to be partially or fully buried in the sloped floor zone (110). The anchor extension (302) may be configured to partially or fully dig into the sloped ocean floor zone when the energy-accumulation apparatus (102) is positioned on the sloped floor zone (110) of the body of water (112).

Referring to FIGS. 2C, 3E, 3G, and 4A, the off-shore anchor assembly (300) includes an anchor line (306) and an off-shore anchor assembly (300) including any one of an anchor body (304) and a mat structure (308). The anchor body (304) may be configured to be partially or fully buried in the sloped floor zone (110). The anchor body (304) may be configured to partially or fully dig into the sloped floor zone (110) when the energy-accumulation apparatus (102) is positioned on the sloped floor zone (110) of the body of water (112). The anchor line (306) may be attached to the energy-accumulation apparatus (102) and to any one of the anchor body (304) and the mat structure (308) by using connection systems similar to that employed by the on-shore anchor (118) and the shore connection (116). For example, the anchor line (306) may be connected to the energy-accumulation apparatus (102) using hook and loop structures or bolts as described for the on-shore anchor (118) above. It should be noted that placement of the off-shore anchor assembly (300) on the sloped floor zone (110) relative to the energy-accumulation apparatus (102) may depend on the conditions of the deployment site. For example, in FIG. 3E, the anchor body (304) may be placed up-slope relative to the energy-accumulation apparatus (102). In other example deployments, the anchor body (304) may be placed in positions other than up-slope relative to the energy-accumulation apparatus (102).

Referring to FIG. 3E and FIG. 3G, any one of the anchor body (304) and the mat structure (308) (respectively) may be placed up-slope, down-slope, or on the same level relative to the energy-accumulation apparatus (102).

Referring to FIGS. 2A, 2B, and 2C, the shore connection (116) defines an air-feed channel (201). This air-feed channel (201) is configured to communicate with the pneumatically-pressurizable chamber (106) of the accumulator body assembly (104) in such a way that pressurized air communicates with a pneumatic-pressure source (202). The pneumatic-pressure source (202) may be positioned on the shore (114) and away from the body of water (112).

Referring to FIGS. 2D, 2E, and 4B, the energy-accumulation apparatus (102) further includes an air-feeder line (210) defining an air-feeder passageway (212). The air-feeder passageway (212) is configured to communicate with the pneumatically-pressurizable chamber (106) of the accumulator body assembly (104) in such a way that pressurized air communicates with a pneumatic-pressure source (202) being positioned on the shore (114) and away from the body of water (112).

As depicted in FIG. 2E and FIG. 2F, the shore connection (116) and the air-feeder line (210) are configured to couple with each other. The shore connection (116) and the air-feeder line (210) are spaced apart from each other once coupled to do just so. When the air-feeder line (210) and the shore connection (116) are coupled and positioned in the ocean, the shore connection (116) maintains, at least in part, the position of the air-feeder line (210) in the body of water (112).

Referring to FIG. 2E, the shore connection (116) and the air-feeder line (210) are coupled together at couplers (214). These couplers (214) are spaced apart from each other. These couplers (214) may also be configured so that the shore connection (116) and the air-feeder line (210) are spaced apart from each other once they are coupled using one or more instances of the couplers (214).

Referring to FIG. 2F, the energy-accumulation apparatus (102) may further include both the shore connection (116) and the off-shore anchor assembly (300). The air-feeder passageway (212) of the air-feeder line (210) is configured to communicate with the pneumatically-pressurizable chamber (106) of the accumulator body assembly (104) in such a way that pressurized air communicates with a pneumatic-pressure source (202) being positioned on the shore (114) and away from the body of water (112).

Referring to FIG. 2G, the shore connection (116) and the air-feeder line (210) are coupled together at couplers (214). The couplers (214) are spaced apart from each other. These couplers (214) may also be configured so that the shore connection (116) and the air-feeder line (210) are spaced apart from each other once they are coupled using one or more instances of the couplers (214).

Referring to FIGS. 2F, 2G and 4A, in addition to the example depicted in FIG. 2E, there is included an off-shore anchor assembly (300). In the example depicted in FIG. 4A, an on-shore anchor (118) is not necessary (or used). The energy-accumulation apparatus (102) is at least partially secured to the sloped floor zone (110) using a combination of different variations of the off-shore anchor assembly (300).

Referring to FIGS. 3A, 3B, 3C, and 4A, the off-shore anchor assembly (300) includes an anchor extension (302) being configured to extend from the accumulator body assembly (104). The anchor extension (302) is configured to extend into the sloped floor zone (110) once the energy-accumulation apparatus (102) is positioned relative to the sloped floor zone (110) to do just so.

In view of the foregoing, a method is provided for securely contacting an outer surface (108) extending from an accumulator body assembly (104) of an energy-accumulation apparatus (102) to a sloped floor zone (110) of the body of water (112), the accumulator body assembly (104) defining a pneumatically-pressurizable chamber (106).

The method may include deploying one or more of the structures described above in a sloped floor zone (110) of a body of water (112).

It will be appreciated that a renewable-energy electric-generating system (900) (depicted in FIG. 2B) includes the energy-accumulation apparatus (102) once the energy-accumulation apparatus (102) is operatively attached thereto. The renewable-energy electric-generating system (900) includes any one of a wind turbine and/or a solar panel. Excess energy generated by the renewable-energy electric-generating system (900) can be stored in the energy-accumulation apparatus (102). In periods of energy deficit, such as the evening for solar-based electric-generating systems, energy can be drawn from the energy-accumulation apparatus (102) so as to supplement, or in some instances replace, the energy provided by the renewable-energy electric-generating system (900).

It will be appreciated that an electric grid (902) (depicted in FIG. 2B) includes the energy-accumulation apparatus (102). As shown in FIG. 2B, the energy-accumulation apparatus (102) can be used in an electric grid (902) so that excess energy in the grid can be reversibly stored in the energy-accumulation apparatus (102). As demand for electricity increases on the grid, energy can be drawn from the energy-accumulation apparatus (102), feeding the stored surplus energy back into the grid.

ADDITIONAL DESCRIPTION

In some situations, a substantially flat floor zone is not available for placing the energy-accumulation apparatus (102). Therefore, the energy-accumulation apparatus (102) is to be securely positioned or placed on a sloped floor zone (110) of the body of water (112). For this case, the shore connection (116) is installed to the on-shore anchor (118) that is securely positioned on the shore (114). The combination of the shore connection (116) and the on-shore anchor (118) are configured to prevent the energy-accumulation apparatus (102) from sliding down the sloped floor zone (110) (over time). The combination of the shore connection (116) and the on-shore anchor (118) is configured to keep the energy-accumulation apparatus (102) stabilized (in position) on the sloped floor zone (110). The shore connection (116) is anchored into, fixedly connected to, the on-shore anchor (118) located on the shore (114), and the energy-accumulation apparatus (102) provides a counter weight on the off-shore side in the body of water (112). The on-shore anchor (118) includes rock or any similar structure, In some examples, a combination of the off-shore anchor assembly (300) and the anchor line (306), having high tensile strength, is connected to the energy-accumulation apparatus (102), and is configured to prevent the energy-accumulation apparatus (102) from sliding down the sloped floor zone (110). The combination of the off-shore anchor assembly (300) and the anchor line (306) is configured to keep the energy-accumulation apparatus (102) stabilized (in position) on the sloped floor zone (110).

In another example, the shore connection (116) is configured to keep the air-feeder line (210) from floating to the surface of the body of water (112). This arrangement includes, for example, secured connection of the shore connection (116) to the air-feeder line (210), every few meters, at spaced apart connection points or coupling points. By way of example, the air-feeder line (210) has an inner diameter of about 10inches to about 36 inches. This arrangement may be used in order to avoid usage of a self-sinking hose for the air-feeder line (210) that has a sinkable weight, such as concrete-coated pipe.

In an example, the shore connection (116) is configured to secure the energy-accumulation apparatus (102) to the sloped floor zone (110). In another example, the off-shore anchor assembly (300), such as a long drag anchor, is deployed down-slope of the energy-accumulation apparatus (102) on the sloped floor zone (110). The tension (force) transmitted between the on-shore anchor (118) and the off-shore anchor assembly (300) via the shore connection (116) is used to reduce or offset the buoyancy of the energy-accumulation apparatus (102). The mat structure (308) may be used in lieu of, or in combination with, instances of the anchor body (304) (such as a drag anchor). The mat structure (308) may be called a geo-tech mat.

It may be appreciated that the assemblies and modules described above may be connected with each other as may be used to perform desired functions and tasks that are within the scope of persons of skill in the art to make such combinations and permutations without having to describe each and every one of them in explicit terms. There is no particular assembly, or components that are superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for the purposes of this document, that the phrase "includes" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. An energy-accumulation apparatus, comprising:

an accumulator body assembly defining a pneumatically-pressurizable chamber being configured to receive air pressure, and the accumulator body assembly being positioned in a body of water at a position being spaced apart from a shore; and a pneumatic-pressure source being positioned on the shore and being located away from the body of water, and the pneumatic-pressure source includes a pressurized air system, and the pneumatic-pressure source being configured to generate air pressure, and the pressurized air system of the pneumatic-pressure source being configured to convey pressurized air to the pneumatically-pressurizable chamber of the accumulator body assembly, and the pneumatically-pressurizable chamber of the pneumatic-pressure source being configured to fill, at least in part, the energy-accumulation apparatus with pneumatically-pressurized air; and an air-feeder line providing an air-feeder passageway being configured to communicate with the pneumatically-pressurizable chamber of the accumulator body assembly in such a way that pressurized air communicates between the pneumatically-pressurizable chamber and the pressurized air system of the pneumatic-pressure source; and an electric generator being positioned on the shore and being located away from the body of water, and the electric generator being configured to generate electricity using the pneumatically pressurized air being released from the pneumatically-pressurizable chamber of the accumulator body assembly in such a way that the electric generator generates electricity to be provided to an electric grid; and an outer surface extending from the accumulator body assembly, and the outer surface securely contacting a sloped floor zone of the body of water at a position being spaced apart from the shore; and an on-shore anchor being positioned on the shore and being spaced apart from the body of water; and a shore connection including a tension line being anchored into and being fixedly connected to the on-shore anchor, and the shore connection connecting the accumulator body assembly to the on-shore anchor, and the shore connection being configured to keep the air-feeder line from floating to the surface of the body of water; and the shore connection and the on-shore anchor preventing the accumulator body assembly from sliding down the sloped floor zone, and the shore connection and the on-shore anchor keeping the accumulator body assembly stabilized in position on the sloped floor zone, and the accumulator body assembly providing a counter weight on the offshore side in the body of water.

2. The energy-accumulation apparatus of claim 1 wherein:

the air-feeder line, the shore connection and the air-feeder line are configured to couple with each other, the shore connection and the air-feeder line are spaced apart from each other once coupled, the shore connection maintaining, at least in part, position of the air-feeder line in the body of water once coupled and positioned in the body of water.

3. The energy-accumulation apparatus of claim 1 further comprising:

an off-shore anchor assembly extending from the energy-accumulation apparatus, and the off-shore anchor assembly being configured to securely anchor, at least in part, the energy-accumulation apparatus to the sloped floor zone; and the off-shore anchor assembly including:

an anchor extension being configured to extend from the accumulator body assembly, and the anchor extension being configured to extend into the sloped floor zone once the energy-accumulation apparatus is positioned relative to the sloped floor zone.

4. The energy-accumulation apparatus of claim 1, further comprising:

an off-shore anchor assembly extending from the energy-accumulation apparatus, and the off-shore anchor assembly being configured to securely anchor, at least in part, the energy-accumulation apparatus to the sloped floor zone; and the off-shore anchor assembly including:

an anchor body being configured to be positioned in the sloped floor zone once the energy-accumulation apparatus is positioned; and an anchor line being configured to operatively connect the anchor body to the accumulator body assembly.

5. The energy-accumulation apparatus of claim 1, further comprising:

an off-shore anchor assembly extending from the energy-accumulation apparatus, and being configured to securely anchor, at least in part, the energy-accumulation apparatus to the sloped floor zone; and the off-shore anchor assembly including:

a mat structure being configured to be positioned in the sloped floor zone once the energy-accumulation apparatus is positioned, the mat structure being configured to be covered by a weight; and an anchor line being configured to operatively connect the mat structure to the accumulator body assembly.

6. A renewable-energy electric-generating system, including:

the energy-accumulation apparatus of claim 1.

* * * * *